United States Patent [19]

Pfalzgraf et al.

[11] Patent Number: 4,853,556

[45] Date of Patent: Aug. 1, 1989

[54] ELECTRICAL DESIRED-VALUE TRANSMITTER, PARTICULARLY FOR AN ELECTRONIC GAS-PEDAL SYSTEM

[75] Inventors: Manfred Pfalzgraf, Frankfurt am Main; Heinz Ungermann, Linsengericht, both of Fed. Rep. of Germany

[73] Assignee: VDO Adolf Schindling AG, Frankfurt am Main, Fed. Rep. of Germany

[21] Appl. No.: 128,228

[22] Filed: Dec. 3, 1987

[30] Foreign Application Priority Data

Dec. 3, 1986 [DE] Fed. Rep. of Germany ..... 3641243

[51] Int. Cl.[4] ..... H01H 3/14

[52] U.S. Cl. ..... 307/10.1; 307/9.1; 200/521; 200/86.5; 200/61.89; 200/303

[58] Field of Search ..... 307/9, 10 R; 200/61.89, 200/61.44, 86.5, 153 C, 334, 337, 86 R, 303, 159; 340/52 R, 52 D, 66, 62, 63, 69; 180/335, 315, 316; 192/3 M, 3 S, 18 R, 18 B; 123/332, 333, 350, 359, 198 D, 198 DC

[56] References Cited

U.S. PATENT DOCUMENTS

| | | | |
|---|---|---|---|
| 1,335,610 | 3/1920 | Schram | 200/61.89 |
| 2,127,764 | 8/1938 | Browder | 200/61.89 X |
| 3,273,552 | 9/1966 | Plath | 200/61.89 X |
| 3,359,540 | 12/1967 | Dunavan | 200/61.89 X |
| 3,427,583 | 2/1969 | Zackey | 200/61.89 X |
| 3,487,183 | 12/1969 | Schulman | 200/61.89 |
| 3,514,554 | 5/1970 | Boysen | 200/303 X |
| 3,532,839 | 10/1970 | Wallace | 200/61.89 |
| 3,671,802 | 6/1972 | Ballou | 200/86.5 X |
| 4,233,479 | 11/1980 | Karpe et al. | 200/159 R X |
| 4,404,535 | 9/1983 | Fastenrath et al. | 200/159 R X |

*Primary Examiner*—William M. Shoop, Jr.
*Assistant Examiner*—Paul Ip
*Attorney, Agent, or Firm*—Martin A. Farber

[57] ABSTRACT

In an electrical desired-value transmitter, particularly for an electronic gas pedal system, a return spring (5) as well as a force elastic jump spring (15) arranged parallel to it are provided. The desired-value transmitter has an electric path converter which gives off an electrical desired-value signal. In order to verify the proper operation of the return spring, a contact spring (9) of a first safety switch contact (10) acts on it in such a manner that the force of the return spring is transmitted to the contact spring. In the event that the return spring is broken, the safety switch contact assumes a position which is characteristic of this and gives off a corresponding signal which can reduce the output of the engine. The electric path converter may be a potentiometer.

7 Claims, 1 Drawing Sheet

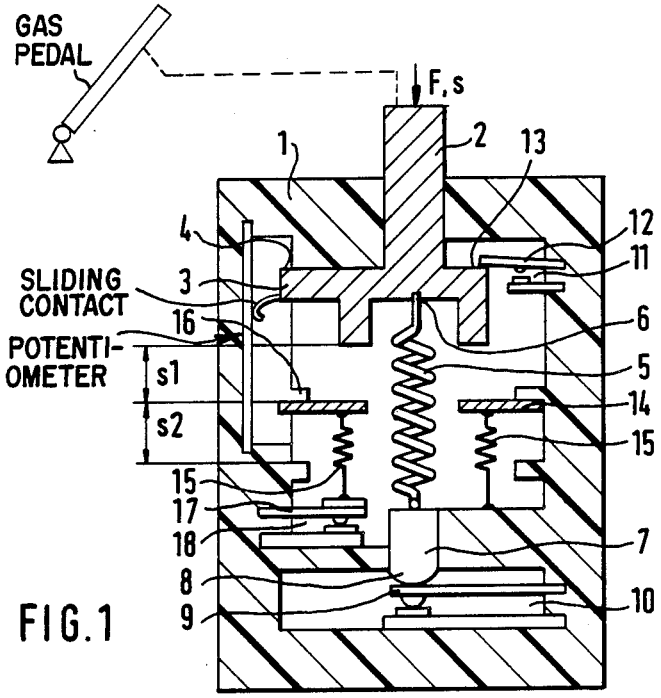
FIG.1
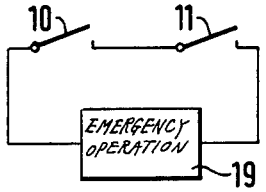
FIG. 2
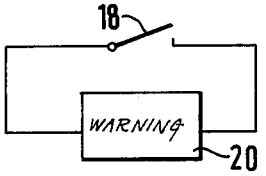
FIG.3
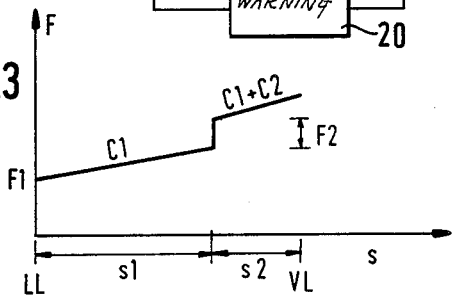

ELECTRICAL DESIRED-VALUE TRANSMITTER, PARTICULARLY FOR AN ELECTRONIC GAS-PEDAL SYSTEM

FIELD AND BACKGROUND OF THE INVENTION

The present invention relates to an electrical desired-value transmitter, particularly for an electronic gas-pedal system in general.

More particularly, the invention relates to an electrical desired-value transmitter, particularly for an electronic gas-pedal system which has a return spring (5), a force elastic jump spring (15) with play arranged parallel thereto, and an electrical path converter which is connected to both springs and gives off a desired-value signal, as well as a safety contact.

Such desired-value transmitters are used in so-called electric gas systems which are developed as follow-up control in order to transmit the position of a gas pedal to a throttle vale or some other element which affects the fuel/air mixture of an internal combustion mixture and is arranged in the vicinity of the combustion engine. For this purpose, the desired-value transmitter, which has an electric path converter, gives off an electric desired-value signal to an electronic regulator in which the desired-value signal is compared with a position feedback signal of the throttle valve. Since the electric gas system is subject to the same safety requirements as a purely mechanical transmission of the position of the gas pedal to the throttle valve by rods or a Bowden cable, it is constructed in accordance with strict criteria of reliability and safety. In order to assure the necessary inherent reliability of the electric gas system, as in the case of a short circuit, a safety contact is provided on the desired-value transmitter which is actuated by the gas pedal and is also known as a pedal contact. This pedal contact is opened in the idling position of the gas pedal and closed upon depressing the pedal after a given path has been exceeded. The pedal contact is arranged in an electrical circuit which furthermore contains a setting-member contact which is connected to the throttle valve as well as a fuel pump relay or a switch which acts on the ignition for reducing the output of the internal combustion engine. The pedal contact and the setting-member contact are so developed and arranged in the manner of an OR gate that only in the case of a disturbance are both contacts opened and, as a result, the gasoline pump turned off via the fuel pump relay or the ignition.

Another safety requirement for electric gas systems is that in case of a break of the return spring which moves the gas pedal automatically into the idle position when it is released, the output of the internal combustion engine be reduced. In order to satisfy this safety requirement, it is state of the art to provide, in addition to the return spring, a second return spring in parallel thereto, so that in the event that one of the two return springs breaks at least a weak return force is still definitely available. The second return spring, however, results in a more complicated construction of the desired-value transmitter. This problem is further intensified if the principle of the redundant return spring is utilized in known desired-value transmitters, which, in addition to the return spring, have at least one force elastic jump spring arranged in parallel with the inclusion of play. The force elastic jump spring produces an additional restoring force when the gas pedal has been depressed a distance which corresponds at least to the play. When the principle of redundant springs is employed, a second force elastic jump spring is also necessary, which further complicates the construction of the desired-value transmitter.

SUMMARY OF THE INVENTION

It is an object of the present invention so further to develop an electrical desired-value transmitter, particularly for an electronic gas pedal system of the aforementioned type, that the operation thereof remains secured against the breakage of the force elastic jump spring without thereby causing a complicated construction and a corresponding lengthy manufacture.

According to the invention, the return spring is so connected to a contact spring (9) of a first safety switch contact (10) that the force of the return spring is transmitted to the contact spring.

Thus, one dispenses with the second return spring which is superfluous, i.e. redundant, when the normal return spring is intact. The arrangement of the return spring in a housing of the desired-value transmitter can thus be kept very simple. No second return spring need be provided and balanced upon the manufacture of the desired-value transmitter. Rather, the return force of the single return spring is monitored. When the return force disappears because the return spring is inactive, particularly because it is broken, the safety switch contact gives off an electric signal which effects a reduction of the output of the internal combustion engine, for instance by disconnecting the gasoline pump via a fuel pump relay or else the ignition.

The desired-value transmitter, which has a return spring which is developed in customary manner as a compression spring, is preferably so developed that the return spring rests at free end, i.e. an end which is not connected to the gas pedal, against a contact spring (9) of the first safety contact (10). Within this desired-value transmitter, the return spring exerts a pushing force not only on the gas pedal but—as reactive force—also the pushing force on the contact spring of the first safety contact. The first safety contact with the contact spring can in this connection be arranged in a simple manner advantageously outside the return spring in a housing of the desired value transmitter, taking up only a small amount of space.

It is furthermore advantageous in the last-mentioned arrangement that the contact spring of the first safety contact itself supplies its return force, which permits the unloaded safety contact to assume a well-defined position of rest.

The development of the desired-value transmitter in accordance with the invention does not require a compression spring as return spring despite the aforementioned preferred embodiment. In particular, in accordance with the principle of the invention, the function of a desired-value transmitter can be monitored in the manner that the electric path converter is not displaced in translation but in rotation.

In the present papers, the safety contact will be referred to as the first safety contact although the desired-value transmitter may have an ordinary pedal contact. One essential difference between the arrangement of the pedal contact and of the first safety contact consists however in the fact that the pedal contact is actuated as a function of the path of angle displacement of the electric desired-value transmitter but does not include any return force.

Analogously to the monitoring of the return spring, the force elastic jump spring can also be monitored in a further development of the invention, namely with a second safety contact.

The second safety contact is preferably such that with a force elastic jump string developed as second compression spring, the force elastic jump spring (15) rests at a free end, i.e. an end which does not come into contact with the return spring after the overcoming of the play, against the contact spring (17) of the second safety contact (18).

Upon a break or fault in the force elastic jump spring, no danger occurs—assuming proper operation of the normal return spring—since the desired-value transmitter is acted on in the direction of the idle position, even though with reduced return force. Faulty operation of the force elastic jump spring thus essentially results only a reduction in comfort for the driver because the progressive force elastic jump action is absent. Since, however, the driver cannot immediately note this condition without pressing the gas pedal practically all the way down, the disturbance in the force elastic jump function of the desired value transmitter is indicated by a warning device which is activated by the second safety contact.

Furthermore, according to the invention, there is provided a desired-value transmitter having a safety contact which is arranged as pedal contact and is opened in the idling position of the gas pedal and closed upon depression of the gas pedal and is arranged within an electric circuit of an element which reduces the engine output, wherein the first safety switch contact (10) is also arranged in the electric circuit of the element (19) which reduces the engine output.

Still further, according to a feature of the invention, the second safety contact (18) lies in an electric circuit of a warning device (20).

BRIEF DESCRIPTION OF THE DRAWING

With the above and other objects and advantages in view, the present invention will become more clearly understood in connection with the detailed description of a preferred embodiment when considered with the accompanying drawing, of which:

FIG. 1 shows the essential construction of the desired value transmitter, but without electric path convertor, diagrammatically in a longitudinal section;

FIG. 2 is a briefly simplified block diagram of the electric circuit with the safety contacts of the desired value transmitter; and FIG. 3 is a characteristic curve of the desired-value transmitter of FIG. 1.

DETAILED DESCRIPTION OF THE PREFERRED EMBODIMENT

FIG. 1 shows a housing 1 of an electrical desired-value transmitter within which a ram 2 connected with a gas pedal is axially displaceable. The ram has a projection 3 by which it rests against a stop 4 in the housing in the idling position. It is normally pushed into this position under the action of a return spring 5 developed as compression spring. The return spring is in force-locked connection at one end 6 with the axial ram. An end, opposite said end 6 and referred to also as the free end since it is not positively moved over the path of the ram, is, on the other hand, connected to a slide piece 7 which is displaceable within the housing in the direction of the force of the compression spring.

One end 8 of the slide piece presses against the contact spring 9 of a so-called first safety contact 10 which is developed as opener. There is thus a force-locked connection between the contact spring 9 of the first safety contact 10 and the front end of the slide piece, which serves as actuating element of the safety contact.

Within the housing 1, a safety contact 11 developed as pedal contact is furthermore so arranged that its contact spring 12 is actuated by another projection 13 of the ram. The safety contact 11 is developed as closer. The contact closes as soon as the ram has moved over a distance from the idle position shown in the drawing.

The compact housing of the desired-value transmitter also comprises construction parts for the production of a force elastic jump when the path s1 moved over by the ram from the idle position is exceeded. The path s1 is the play between a front end of the axial ram 2 and a bushing 14 which is axially displaceable within the housing. The bushing is pressed by a force elastic jump spring 15 upwards against a stop 16. The force elastic jump string is concentric to the return spring 5 and can be represented in very simple fashion as two individual springs, which therefore bear the same reference number. One end of the force elastic jump spring rests against a contact spring 17 of a second safety contact 18 which is developed as opener. The spring force of the contact spring 17 is in this connection less at the place of engagement of the force elastic jump spring 15 than the compressive force thereof. Similarly, the same applied with respect to the return force of the contact spring 9 of the first safety contact 10 with respect to the compressive force of the return spring 5. Also shown in FIG. 1 is a potentiometer supported by the housing for providing an electric signal indicating the position of a gas pedal connected to the ram 2, in accordance with the customary construction of an electrical desired-value transmitter. A sliding contact of the potentiometer is carried by the ram 2.

FIG. 2, shows the electrical connection of the safety switch contacts. It is shown that the first safety switch contact 10 lies in series with the safety switch contact 11, which represents the actual pedal contact. This series connection is connected to an element 19, for instance a fuel pump relay for the reduction of the engine output. This element is so connected that the engine power is reduced when the series circuit of the contacts 10 and 11 does not conduct current, i.e., either the first or the second safety switch contact 10 or 11 is opened. The second safety switch contact 18, which is actuated merely as a function of the force elastic jump spring is, on the other hand, so connected to a warning device that said device is only activated when the switch 18 is opened.

FIG. 3 shows the force/path curve of the desired-value transmitter shown in FIG. 1 when the return spring and the force elastic jump spring are intact. In this case, the return force which is caused by the return spring increases proportionally to the path deflection of the ram 2 from the idle position LL up to the end of the play s1. Upon further depression of the gas pedal and corresponding displacement of the ram downward, its front end comes to rest against the top of the bushing 14 so that now also the force elastic jump spring 15 opposes further displacement of the ram 2 in the direction of larger throughputs of fuel-air mixture. At this place a force elastic jump F2 takes place and upon displacement beyond same the ram can be displaced only with the overcoming of a larger return force which is caused by the springs 5 and 15 which lies in parallel. The paths s1 and s2 shown in FIG. 3 are the possible displacement paths of the ram 1 and the bushing 14 respectively. The function of the first safety switch contact and of the second safety switch contact is, however, not directly dependent on these paths since the release of the safety switch contacts takes place as a function of the forces acting on time.

We claim:

1. In an electrical desired-value transmitter, particularly for an electronic gas-pedal system including a gas pedal, the transmitter comprising a return spring, and a force elastic jump spring with play arranged parallel to said jump spring;

an electrical path converter which is connected to said return spring;

a housing permitting displacement of said converter relative to said return spring and said jump spring, said converter being disconnected from said jump spring upon release of said pedal and coming into engagement with said jump spring upon displacement through a predetermined distance of said play, said converter being operatively connected to said gas pedal to provide displacement of said converter upon movement of said gas pedal, said converter generating a desired value signal in response to a position of the gas pedal; and a safety switch contact having a contact spring, said safety switch being positioned by said housing for engagement with said return spring; and wherein the return spring is mechanically connected to said contact spring of said safety switch contact for transmitting a force of the return spring against the contact spring.

2. The transmitter according to claim 1, wherein a free end of the return spring, opposite the gas-pedal, rests against said contact spring of said safety switch contact.

3. The transmitter according to claim 1, further comprising:

a second safety switch contact; and wherein the force elastic jump spring acts against a contact spring of said second safety contact to allow an additional return setting force, produced by the force elastic jump spring, to be transmitted to the contact spring of the safety switch contact.

4. The transmitter according to claim 2, further comprising;

a second safety switch contact; and wherein the force elastic jump spring acts against a contact spring of said second safety contact to allow an additional return setting force, produced by the force elastic jump spring, to be transmitted to the contact spring of the second safety switch contact.

5. The transmitter according to claim 3, wherein said force elastic jump spring is developed as a compressing spring, and said force elastic jump spring rests at a free end, away from said converter, against a contact spring of said second safety contact.

6. The transmitter according to claim 1, further comprising an electric circuit having an element which reduces engine output; and wherein said safety switch contact is arranged as pedal contact and is opened in an idling position of the gas pedal and closed upon depression of the gas pedal, said safety switch contact being arranged within said electric circuit and connected to the element which reduces the engine output.

7. The transmitter according to claim 3, further comprising an electric circuit having a warning device; and wherein the second safety switch contact is in said electric circuit and connects with said warning device.

* * * * *